US005855153A

United States Patent [19]

Cote et al.

[11] Patent Number: 5,855,153

[45] Date of Patent: Jan. 5, 1999

[54] METHOD AND APPARATUS FOR CONVEYING FLAT PRINTED PRODUCTS

[75] Inventors: Kevin Lauren Cote, Durham; Richard Daniel Curley, Dover, both of N.H.

[73] Assignees: Heidelberg Harris Inc., Dover, N.H.; Heidelberger Druckmaschinen AG, Heidelberg, Germany

[21] Appl. No.: 707,518

[22] Filed: Sep. 4, 1996

[51] Int. Cl.[6] ..... B26D 7/06

[52] U.S. Cl. ..... 83/23; 83/86; 83/89; 83/110; 83/154

[58] Field of Search ..... 83/23, 84, 86, 83/89, 110, 151, 154; 271/82, 187, 270

[56] References Cited

U.S. PATENT DOCUMENTS

| | | | |
|---|---|---|---|
| 3,244,306 | 4/1966 | Hawley et al. | 83/23 |
| 3,675,522 | 7/1972 | Hull | 83/154 |
| 3,999,454 | 12/1976 | Tiso et al. | 83/154 |
| 4,132,403 | 1/1979 | Weisbach et al. . | |
| 4,170,927 | 10/1979 | Van Der Meulen | 83/86 |
| 4,283,973 | 8/1981 | Spenser | 83/151 |
| 4,290,595 | 9/1981 | Thunker . | |
| 4,385,537 | 5/1983 | Wolf | 83/154 |
| 4,629,175 | 12/1986 | Fischer et al. . | |
| 4,765,214 | 8/1988 | Nakaya | 83/154 |
| 4,767,112 | 8/1988 | Kobler . | |
| 4,781,091 | 11/1988 | Nakaya | 83/154 |
| 4,919,027 | 4/1990 | Littleton | 83/110 |
| 5,249,493 | 10/1993 | Breton | 83/154 |
| 5,293,797 | 3/1994 | Spalding et al. | 83/110 |
| 5,452,886 | 9/1995 | Cote et al. . | |
| 5,460,479 | 10/1995 | Neumann et al. | 271/218 |
| 5,560,599 | 10/1996 | Curley et al. | 271/270 |

FOREIGN PATENT DOCUMENTS

| | | | |
|---|---|---|---|
| 1051110 | 2/1959 | Germany | 83/154 |

*Primary Examiner*—M. Rachuba

*Attorney, Agent, or Firm*—Burns, Doane, Swecker & Mathis, LLP

[57] ABSTRACT

The present invention is directed to a conveying device for flat printed products. Exemplary embodiments include a transport device for transporting signatures. A plurality of arms, each having a seizing device, are assigned to the transport device for seizing signatures emerging from the transport device. Upon rotational movement of the arms, the seizing devices dive into non-raised portions of a transporting element of the transporting device for seizing a leading edge of respective signatures.

17 Claims, 4 Drawing Sheets

METHOD AND APPARATUS FOR CONVEYING FLAT PRINTED PRODUCTS

BACKGROUND OF THE INVENTION

1. Field of the Invention

The present invention relates to a method and apparatus for conveying flat printed products, and more particularly, to a method and apparatus for conveying flat printed products with respect to a rotary printing press.

2. State of the Art

U.S. Pat. No. 4,132,403 discloses a sheet transfer apparatus for a printing press. Sheets are moved from a supply to a continuously rotating receiver drum in a printing press by a transfer drum having at least two angularly spaced grippers. The transfer drum carrying the grippers is rotated at a relatively slow speed, and each of the grippers can be angularly displaced on the transfer drum and relative to the other gripper. Thus, each gripper is accelerated after it picks up a sheet at the pick-up station, so that when the gripper reaches a transfer station where it passes the sheet onto the receiver drum, it is moving at the same speed as the receiver drum. Thereafter, each gripper is uniformly decelerated, so that when it has returned to the pick-up station it is moving at the same speed as the sheet thereat.

U.S. Pat. No. 4,290,595 shows a rotatable advance or forward gripper drum. A continuously rotatable advance gripper drum assembly for sheet-fed rotary printing presses has an advance gripper drum and a gripper bridge movable relative to the drum. Furthermore, it includes a crank-driven linkage transmission device disposed on and rotatable with the drum and operatively connected to the gripper bridge for moving the gripper bridge.

U.S. Pat. No. 4,629,175 discloses a method and an apparatus for the stream-fed delivery of sheet products. Sheet-like products coming from a folder are first transported some distance before being caused to overlap. In order to slow down the products to cause the overlapping to take place and to arrange the products in a perfectly regular feed stream without being damaged, the products are engaged by grippers that are moved along a preferably arcuate path on a support in the course of which the products are slowed down by the grippers to the speed of a delivery belt on which the products are then deposited.

Finally, U.S. Pat. No. 4,767,112 discloses a folded copy product transfer and transport apparatus. To transport folded copy products without engaging an arm between the creased or folded sheets of a folded copy product, a sprocket chain has grippers secured thereto which have gripper arms at their remote end. The gripper elements are guided in an arcuate path at a transfer position or station, the folded copy product being pushed between a counter surface and a movable tongue of the gripper elements which then close due to the pressure of a spring. The gripper elements can open and close under the control of a cam to receive the copy products. The copy products can be transported in imbricated or shingled formation to a reception or delivery station.

Existing pinless folder designs have encountered the technical problem that a signature transfer from the cutting cylinders to a tape system involves a velocity differential between the cutting cylinders' surface and the driving surface of the tapes of the tape system. Through this velocity differential, a gap between adjacent signatures can be created. Consequently, the signatures can be transferred to a slowdown device.

To create and to maintain this gap between adjacent signatures, the tapes of the tape system must travel at higher velocity than the cutting cylinder surfaces. This results in a relative movement between the tape surfaces and the surface of the signature, until the signature is severed from the web by a transversal cut between the cutting cylinders. Consequently, the signatures are subjected to considerable mechanical stress which can result in signature damage or marking.

SUMMARY OF THE INVENTION

Accordingly, an object of the present invention is to eliminate a velocity differential between surfaces of the cutting cylinders and the tape system assigned thereto.

A further object of the present invention is to minimize a variation in distance between signatures conveyed by a deceleration device.

A still further object of the present invention is to allow for reliable and safe seizing of such signatures emerging from a tape system.

According to exemplary embodiments of the present invention, a conveying device for flat printed products comprises a transport device for transporting signatures, a plurality of arms, each having a seizing device assigned to said transport device for seizing said signatures emerging from said transport device, said seizing devices of said arms, upon rotational movement thereof, diving into non-raised portions of a transport element of said transport device for seizing a leading edge of a respective signature.

Exemplary embodiments of the present invention offer the significant advantage that there now is enough space for a seizing device to move with one component thereof behind the leading edge of signatures. The non-raised portions on the revolving transport elements now allow for a deflection of the preceding signature's trailing edge, without the signatures interfering with each other.

A further advantage of the transport device according to exemplary embodiments of the present invention is that a revolving transport element of the transport device is a segmented tape having raised and non-raised surface portions. Upon rotational movement, arms, each having a seizing device, dive into said non-raised portions of said segmented tapes which deflect trailing edges of preceding signatures and seize the leading edge of the respective next signature. Thus, a distance between signatures to be conveyed is no longer required, as now there is space enough to let the seizing devices dive into the non-raised portions of said segmented belts to more reliably seize the leading edge of a signature. Since a distance between the signatures is no longer required, the velocity differential between cutting cylinder surfaces and the tape system can be eliminated as well.

BRIEF DESCRIPTION OF THE DRAWINGS

The foregoing and other features of the present invention will become apparent to those skilled in the art upon reading the following description of preferred embodiments of the invention in conjunction with the accompanying drawings, wherein.

DETAILED DESCRIPTION OF THE PREFERRED EMBODIMENTS

Figure 1A:
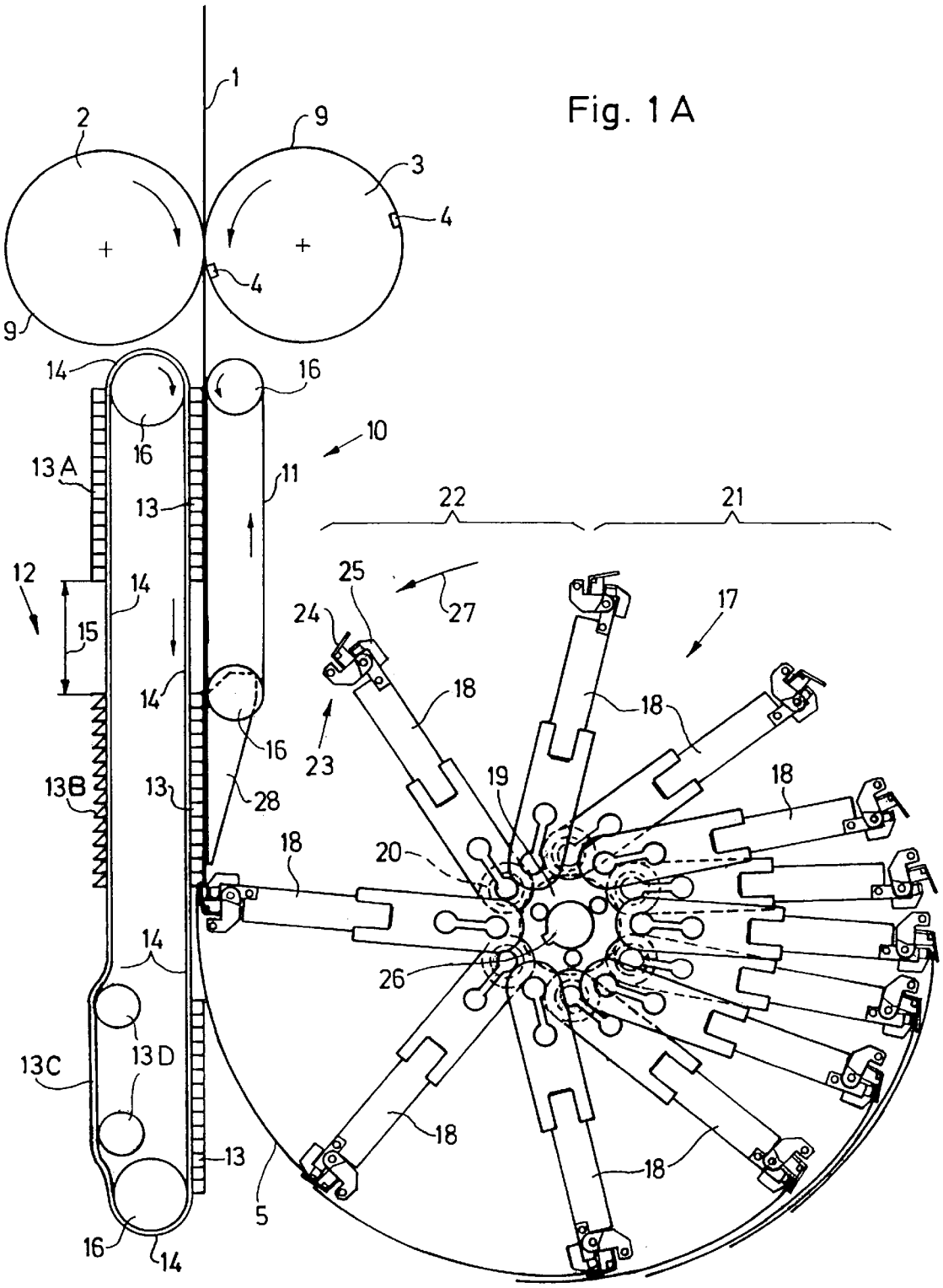
FIG. 1A shows rotating arms of an exemplary deceleration device assigned to a transport device for signatures emerging from the nip between a pair of cutting cylinders.

FIG. 1A shows the general arrangement of an exemplary embodiment of the invention. In the FIG. 1A embodiment, a continuous web of material 1 enters a nip between a pair of cutting cylinders represented as an anvil cylinder 3 having anvil bars 4 arranged on its circumference and a cutting cylinder 2. After a transversal cut has been performed, the signatures emerging from the nip between the cylinders' surfaces 9 move into a transporting device 10. The transporting device 10 includes cooperating revolving elements illustrated in FIG. 1A as a flat tape 11 and a segmented tape 12, each of the tapes 11, 12 rotating about rollers 16.

The segmented tapes 12 include raised (e.g., thick) portions 13 and non-raised (e.g., thin) portions 14, or voids, the raised portions 13 being regularly spaced from one another by a spacing distance 15. The raised portions 13 substantially support first and second signatures 5, 6, as shown in detail in FIGS. 2 and 3. In accordance with an exemplary embodiment, the length of the signatures 5, 6 exceeds the length of the raised portions 13. The drive of the rollers 16 and the drive of the pair of cutting cylinders 2, 3 are connected such that the cutting cylinder surfaces 9 and the surface speed of the raised portions 13 of the segmented tapes 12 are substantially equal. Thus, the velocity differential between the cutting cylinders 2, 3 and the transport device 10 is eliminated. Consequently, the signatures 5, 6 emerging from the nip transversely cut are conveyed adjacent to one another within the transport device 10.

A deceleration device 17 is assigned to the transport device 10 shown in FIG. 1A. The deceleration device 17 includes several arms 18 which rotate about an axis of rotation 26.

As described in U.S. patent application Ser. No. 08/103,842, now U.S. Pat. No. 5,452,886, the disclosure of which is hereby incorporated by reference in its entirety, the arms 18 are rotatably mounted via bearings at pivots 31 of FIG. 1B. The arms 18 are mounted to a pivot disk which is not shown in the Figures. As described in U.S. Pat. No. 5,452,886, the pivot disk to which the arms 18 are mounted is located in a plane beneath the arms 18 of FIG. 1B and above a star-shaped control disk represented in FIG. 1B as disk-shaped element 19. The pivot disk rotates about an axis 26. As is reflected by the circumference of a circle passing through the pivots 31 of each of the arms 18 in the exemplary FIG. 1B embodiment, the pivot disk is smaller in diameter than the disk-shaped element 19, and is offset with respect to the disk-shaped element 19 such that the pivot disk rotates about axis 26 while the disk-shaped element 19 rotates about axis 26A. However, the pivot disk and the disk-shaped element 19 rotate at the same speed in accordance with an exemplary embodiment.

As described in U.S. Pat. No. 5,452,886, although the arms 18 are directly connected to the pivot disk via pivots 31, the arms 18 are not directly connected to the disk-shaped element 19. Rather, to provide a desired velocity profile for the arms 18 as they rotate about axis 26, one end of a control link 19A associated with each arm 18 is connected to a respective pivot point 34 of the disk-shaped element 19. A second end of each control link 19A is connected to a respective arm 18 via a pivot 33. The control links 19A determine the positions of the arms 18 at each point of the velocity profile established by the FIG. 1B configuration (i.e., the velocity profile is established by the differently sized diameters of the pivot disk and the disk-shaped element, and by their eccentric axes of rotation). The arms 18 of the deceleration device 17 rotate about the axis of rotation 26 in a direction of rotation indicated by the arrow 27.

Figure 1B:
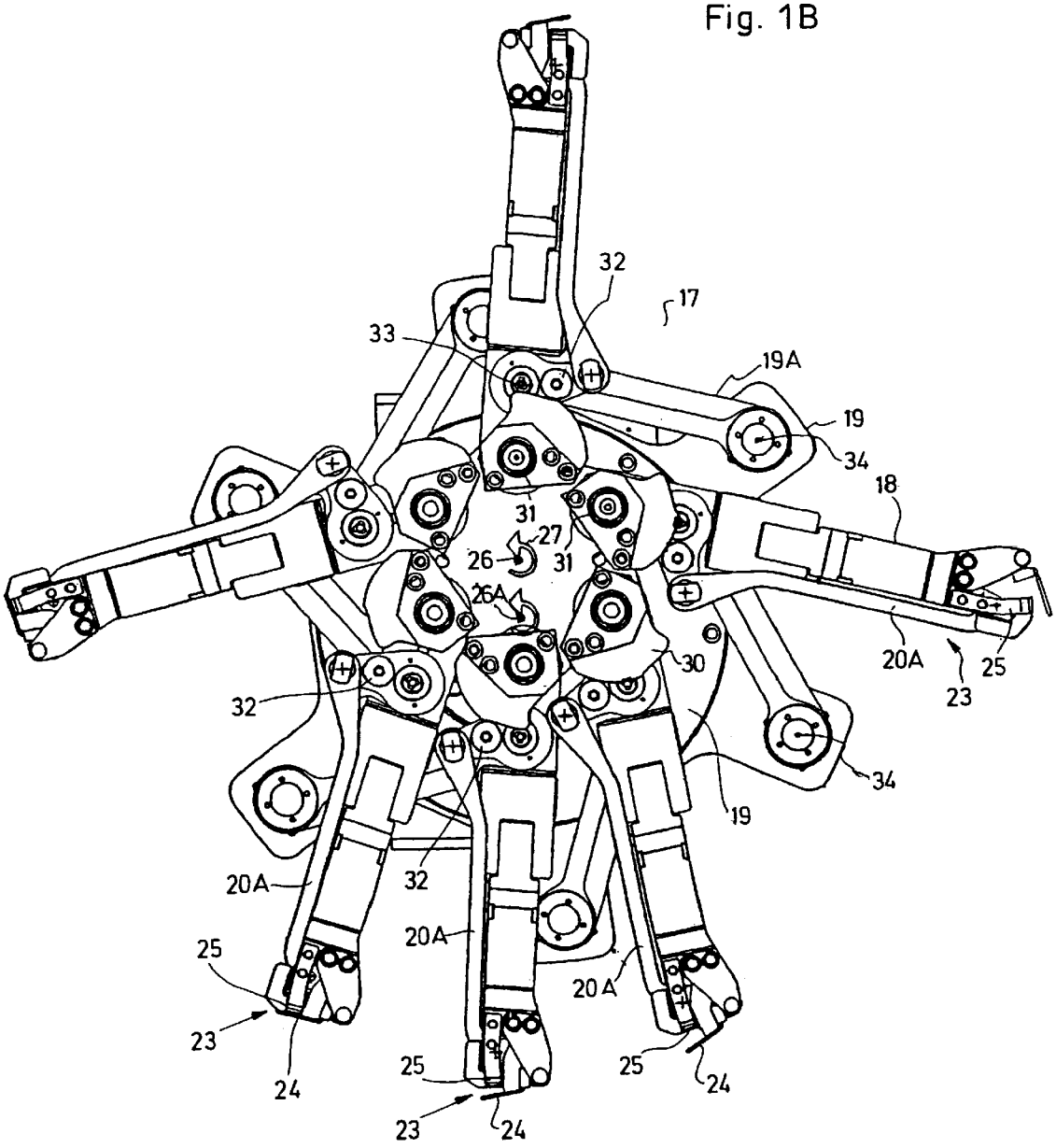
FIG. 1B shows another view of the exemplary deceleration device illustrated in FIG. 1A.

In the exemplary embodiment illustrated in FIG. 1B, each of the arms 18, at its remote end, comprises a seizing device 23 having a seizing member formed, for example, with a movably mounted gripper finger 24 and a fixedly mounted gripper bar 25. Control levers 20A are mounted on each of the arms 18, the control levers being used in connection with cams 30 and cam followers 32 to cause gripper fingers 24 to open and close as the arms 18 are rotated by the pivot disk about the axis 26. Thus, with the disk-shaped element 19 being mounted eccentrically with respect to the axis 26, a non-uniform velocity profile is imposed on the rotating arms 18, and in addition, the gripper fingers 24 are caused to open at a predetermined point of this profile.

Referring to FIG. 1B, in an area of maximum tangential velocity 22, the tangential velocity of the arms 18 is substantially equal to the velocity of the signatures emerging from the nip between the raised portion 13 and the triangle-shaped element (for example, a sheet guide 28) below the flat tape 11. In an area of minimum tangential velocity 21, the tangential velocity of the rotating arms 18 is close to the tangential velocity of a delivery system seizing the slowed down signatures 5 and 6 from said rotating arms 18.

Since the rotational movement of the arms 18 is phased to the passage of the non-raised surface portions 14, the seizing devices 23 move into the area of the non-raised portions 14, thereby allowing for a more reliable grip of the signatures' leading edges as they emerge from the sheet guide 28. After a leading edge 7 of a signature to be decelerated is seized, the arms 18 decelerate gradually on their path of rotation along the axis of rotation 26. Thus, upon rotational movement of the arms 18, a shingled formation of signatures is created, with each of the respective seizing devices 23 having seized a single signature.

The rotational movement of the arms 18 about the axis of rotation 26 is thus performed with a non-uniform velocity profile of the arms 18. The arms move with a relatively lower velocity in the circumferential direction in the deceleration area 21 of minimum tangential velocity, and they move with a higher velocity in the circumferential direction in the acceleration area 22 of maximum tangential velocity.

Figure 2:
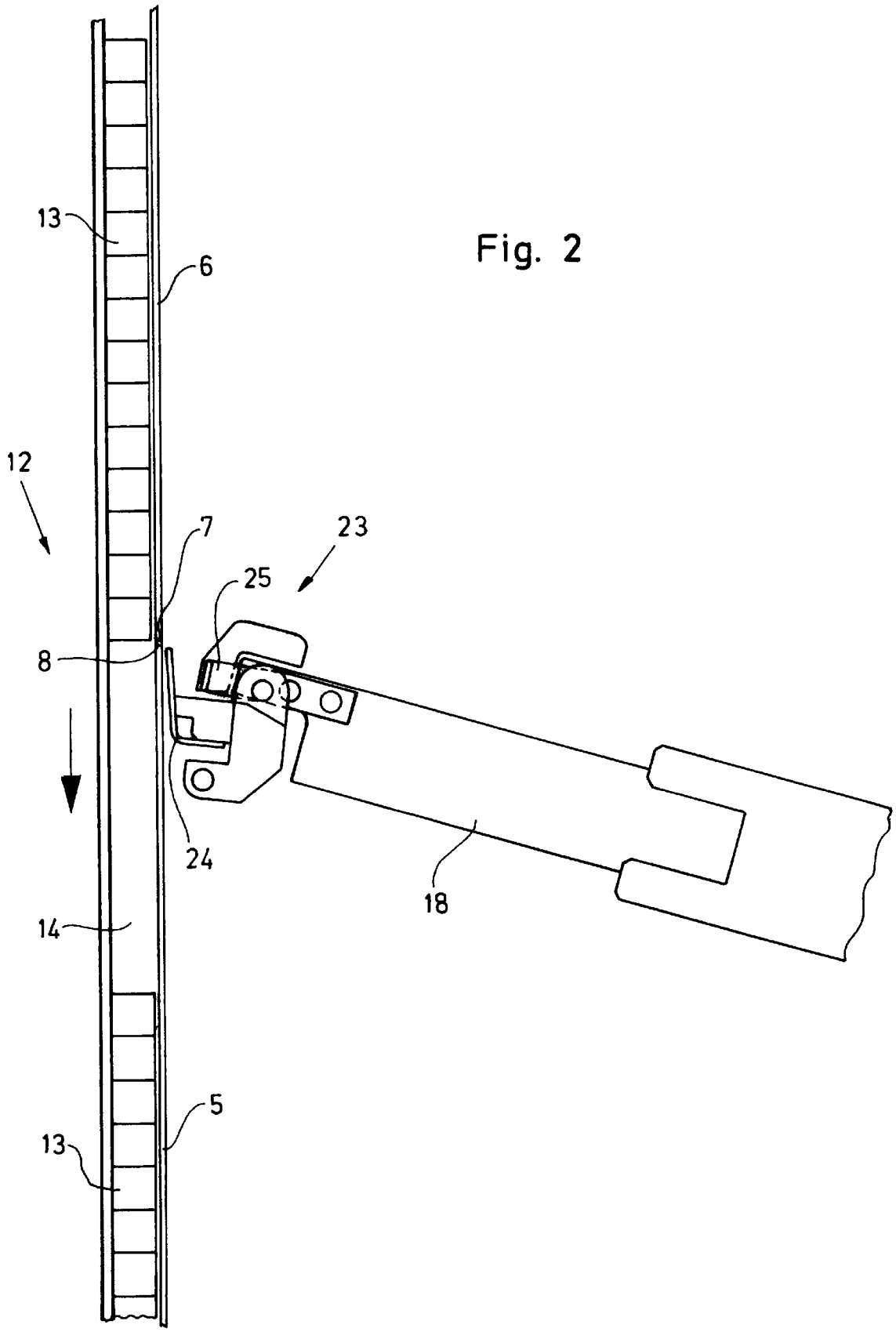
FIG. 2 shows the state of rotation of a respective arm having a seizing device, prior to the seizing device's dive into a void of a segmented belt.
Figure 3:
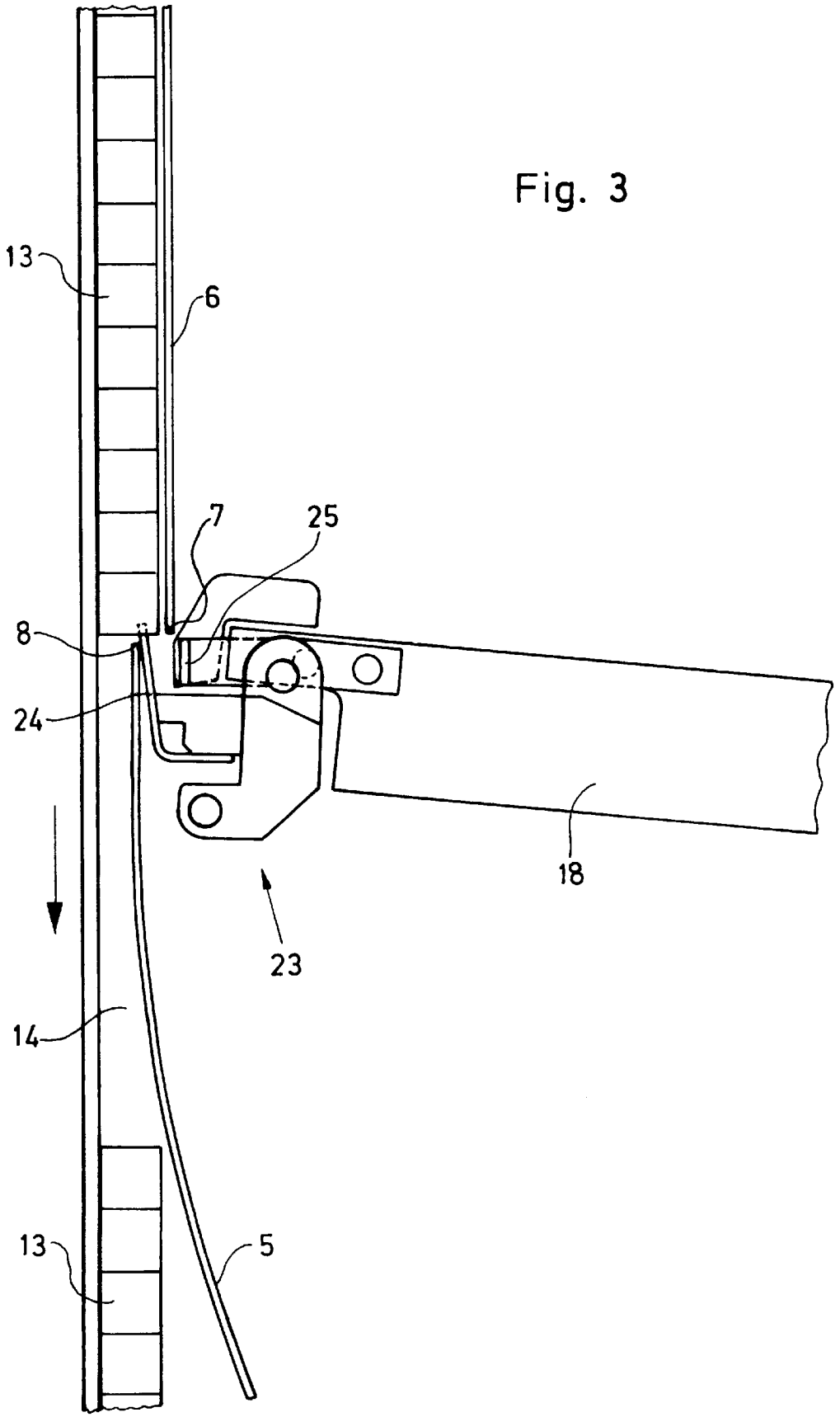
FIG. 3 shows the seizing device deflecting the trailing edge of a first signature in a void, the leading edge of a second signature entering the area between components of the seizing device.

FIGS. 2 and 3 show an exemplary signature transfer from the transport device to the seizing device 23 in greater detail.

In FIG. 2 the arm 18 having a seizing device 23 attached thereto, moves rotationally in phase with the non-raised surface portion 14 of the segmented tape 12. The seizing device 23 comprises a movably mounted gripper finger 24 and a fixedly mounted gripper bar 25. At the point of time illustrated in FIG. 2, the gripper finger 24 is shown prior to its use in deflecting a preceding signature-trailing edge 8. It is to be noted that the signatures 5, 6 to be conveyed have no distance (that is, no gap) between each other. A leading edge 7 of the following signature 6 to be conveyed is shown adjacent to the trailing edge 8 of signature 5. The second signature 6 is substantially supported by the raised portion 13, whereas the trailing edge 8 of the first signature 5 is arranged above the non-raised portion 14 allowing for a deflection of the respective trailing edge 8.

FIG. 3 shows the gripper finger 24 having deflected the trailing edge 8 of the first signature 5 upon the rotational and radial movement of the gripper finger. The trailing edge 8 moves into the area of the non-raised portion 14, thus allowing the gripper finger 24 to move behind the leading edge 7 of the second signature 6. Thus, the leading edge 7 of the second signature 6 can be reliably seized between the gripper finger 24 and the gripper bar 25, while the second signature 6 is kept in a defined position. There is no need to maintain a distance between the respective edges of signatures, since the seizing of each signatures' leading edge 7 is performed without any interference by a preceding signature. That is, the seizing devices 23 have room to move into a position to securely grip each emerging signature. The voids represented by the non-raised surface portions 14 on the segmented belts 12 thus form revolving signature-transfer areas which are phased to the rotational movement of the arms 18.

The raised portions 13 on the segmented tapes 12 or belts can, in an exemplary embodiment, be made of an elastic synthetic material or an elastomer. These raised portions 13 can be fastened to the tapes 12 (for example, element 13A of FIG. 1A) or can have tooth-shaped recesses (for example, element 13B of FIG. 1A), allowing for the gripper fingers 24 to securely engage the leading edges 7 of the respective signatures 5, 6 to be conveyed. As an alternate, sequences of raised and non-raised portions 13, 14 of the tape 12 can be created by using deflecting rollers to change the path of a tape 12 which is not itself formed with separate raised and non-raised portions; that is, as shown by raised portion 13C of FIG. 1A, deflection rollers 13D can be used to deflect the tape to establish raised and non-raised portions of the transport element. Of course, the deflection rollers need only be included to establish a raised portion of tape 12 in a vicinity of the deceleration device 17 where the seizing devices 23 move into an area of a non-raised portion. As those skilled in the art will appreciate, any combination of techniques for establishing raised portions can be used.

It will be appreciated by those skilled in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. Apparatus for conveying flat products, comprising:

a transport device for transporting flat products, said transport device having a transporting tape formed with alternating raised and non-raised portions; and a deceleration device having a plurality of arms, for rotation about an axis in operative communication with said transporting tape, each of said plurality of arms having a seizing device for seizing flat products emerging from said transport device, each of said seizing devices, upon rotational movement of said plurality of arms, being moveable into a non-raised portion of said transporting tape of said transport device to seize a leading edge of one of said flat products.

2. Apparatus according to claim 1, wherein said transport device further includes:

cooperating revolving elements.

3. Apparatus according to claim 2, wherein said cooperating revolving elements further include:

a flat tape and said transporting tape.

4. Apparatus according to claim 3, wherein said of said transporting tape further includes:

a regular spacing between said raised portions.

5. Apparatus according to claim 1, wherein a length of each flat product to be conveyed exceeds a length of each of said raised portions on said transporting tape.

6. Apparatus according to claim 1, wherein said transport device operatively arranges trailing edges of said flat products substantially over said non-raised portions on said transporting tape.

7. Apparatus according to claim 1, wherein each of said seizing devices further include:

a stationary member and a movable member.

8. Apparatus according to claim 3, wherein upon entry of at least one of said seizing devices into a non-raised portion of said transporting tape, said transport device arranges a leading edge of a flat product between said movable member and said stationary member of said at least one seizing device.

9. Apparatus according to claim 1, further including:

a pair of cutting cylinders, wherein a surface velocity of said pair of cutting cylinders is substantially equal to a surface velocity of a flat tape and of said transporting tape of said transport device.

10. Apparatus according to claim 3, further including:

a pair of cutting cylinders, wherein a surface velocity of said pair of cutting cylinders is substantially equal to a surface velocity of said flat tape and of said transporting tape.

11. Apparatus according to claim 1, wherein the rotational movement of said plurality of arms having seizing devices attached thereto is phased with movement of non-raised portions of said transporting tape.

12. Apparatus according to claim 3, wherein the rotational movement of said plurality of arms having seizing devices attached thereto is phased with movement of non-raised portions of said transporting tape.

13. Method for conveying flat products comprising the steps of:

transporting the flat products on a transport device having a transporting tape which has raised and non-raised portions; and deflecting at least one of the flat products with a seizing device assigned to said transport device, where the seizing device dives into one of the non-raised portions of said transporting tape while seizing a leading edge of a subsequent on of the flat products as said at least on of the flat products is deflected.

14. Method according to claim 13, wherein said step of transporting further includes a step of:

arranging trailing edges of said flat products substantially over non-raised portions of said transporting tape used to transport the flat products.

15. Method according to claim 14, wherein said step of transporting further includes the step of:

arranging a leading edge of said subsequent one of the flat products between a movable member and a stationary member of said seizing device.

16. Method according to claim 15, wherein rotational movement of said seizing device is phased with movement of said non-raised portions.

17. Apparatus according to claim 1, wherein the sequences of raised and non-raised portions of the transporting tape are created by deflecting rollers which change the path of the tape.

* * * * *